US006653786B2

(12) United States Patent
Fukushima et al.

(10) Patent No.: US 6,653,786 B2
(45) Date of Patent: Nov. 25, 2003

(54) SUPER-HIGH PRESSURE MERCURY LAMP

(75) Inventors: Kensuke Fukushima, Kakogawa (JP); Tetu Okamoto, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/152,003

(22) Filed: May 22, 2002

(65) Prior Publication Data

US 2002/0175624 A1 Nov. 28, 2002

(51) Int. Cl.[7] ..... H01J 61/12
(52) U.S. Cl. ..... 313/637; 313/639
(58) Field of Search ..... 313/567, 568, 313/571, 572, 637, 638, 639, 640

(56) References Cited

U.S. PATENT DOCUMENTS 5,109,181 A 4/1992 Fischer et al.
5,497,049 A 3/1996 Fischer

FOREIGN PATENT DOCUMENTS

JP 7-215731 8/1995

*Primary Examiner*—Vip Patel
(74) *Attorney, Agent, or Firm*—Nixon Peabody LLP; David S. Safran

(57) ABSTRACT

A high pressure mercury lamp for a projector device in which a discharge vessel made of quartz glass is filled with at least 0.15 mg/mm$^3$ mercury in which both devitrification of as well as damage to the discharge vessel can be eliminated is obtained by the quartz glass of the discharge vessel being given a fictive temperature of 1000° C. to 1250° C., a total content of alkali metals of 0.1 ppm by weight to 3 ppm by weight and an aluminum content of from 1 ppm by weight to 30 ppm by weight.

6 Claims, 3 Drawing Sheets

| Example | Alkali concentration (wt. ppm) | Al concentration (wt. ppm) | fictive temperature (°C) | Damage of arc tube | Devitrification of arc tube |
|---|---|---|---|---|---|
| 1 | 0.28 | 3.1 | 1080 | O | O |
| 2 | 0.57 | 6.7 | 1120 | O | O |
| 3 | 1.71 | 20 | 1100 | O | O |
| 4 | 1.55 | 18.2 | 1050 | O | O |
| 5 | 0.67 | 6.5 | 1145 | O | O |
| 6 | 1.21 | 17.1 | 1125 | O | O |
| 7 | 0.22 | 10.2 | 1134 | O | O |
| 8 | 0.11 | 7.5 | 1192 | O | O |
| 9 | 1.24 | 22.5 | 1115 | O | O |
| 10 | 1.13 | 18.6 | 1145 | O | O |
| 11 | 0.15 | 3.7 | 1120 | O | O |
| 12 | 0.38 | 4.4 | 1121 | O | O |
| 13 | 0.12 | 2.3 | 1165 | O | O |
| 14 | 0.81 | 11.9 | 1159 | O | O |
| 15 | 0.95 | 13.7 | 1185 | O | O |
| 16 | 0.42 | 7.2 | 1180 | O | O |
| 17 | 2.55 | 28.9 | 1190 | O | O |
| 18 | 1.86 | 17.3 | 1214 | O | O |
| 19 | 2.89 | 29.6 | 1203 | O | O |
| 20 | 1.05 | 15.3 | 1200 | O | O |
| 21 | 0.66 | 7.8 | 1225 | O | O |
| 22 | 0.32 | 4.6 | 1230 | O | O |
| 23 | 0.58 | 13.2 | 1213 | O | O |
| 24 | 1.84 | 19.8 | 1247 | O | O |
| 25 | 2.64 | 23.2 | 1250 | O | O |
| 26 | 2.94 | 29.8 | 1237 | O | O |

Fig.2

| Comparative Example | Alkali concentration (wt. ppm) | Al concentration (wt. ppm) | fictive temperature (°C) | Damage of arc tube | Devitrification of arc tube |
|---|---|---|---|---|---|
| 1 | 0.72 | 7.2 | 1265 | △ | × |
| 2 | 0.65 | 10.3 | 1280 | × | × |
| 3 | 1.3 | 12.8 | 1408 | × | × |
| 4 | 2.6 | 28.6 | 1263 | △ | × |
| 5 | 0.23 | 4.6 | 1281 | × | × |
| 6 | 0.48 | 6.9 | 1293 | × | × |
| 7 | 1.9 | 23.5 | 1275 | × | × |
| 8 | 1.6 | 19.6 | 1285 | × | × |
| | | | | | |
| 9 | 3.6 | 15.6 | 1186 | × | × |
| 10 | 10.9 | 23.5 | 1166 | × | × |
| 11 | 4.8 | 5.9 | 1086 | △ | × |
| 12 | 5.2 | 20.7 | 1123 | × | × |
| 13 | 21.6 | 29.5 | 1146 | × | × |
| 14 | 30.5 | 28.6 | 1128 | × | × |
| 15 | 18.9 | 15.3 | 1132 | × | × |
| 16 | 8.5 | 12.3 | 1172 | × | × |
| | | | | | |
| 17 | 0.23 | 45.3 | 1195 | × | △ |
| 18 | 0.39 | 62.3 | 1221 | △ | × |
| 19 | 1.56 | 32.8 | 1132 | × | × |
| 20 | 2.33 | 88.7 | 1166 | × | × |
| 21 | 1.28 | 35.3 | 1149 | × | × |
| 22 | 0.86 | 50.9 | 1183 | × | × |
| 23 | 0.55 | 41.3 | 1170 | △ | × |
| 24 | 1.76 | 96.6 | 1189 | × | × |

Fig.3

SUPER-HIGH PRESSURE MERCURY LAMP

BACKGROUND OF THE INVENTION

1. Field of the Invention

The invention relates to a high pressure mercury lamp, especially to a super-high pressure mercury lamp of the short arc type in which a discharge vessel is filled with at least 0.15 mg/mm$^3$ mercury and in which the mercury vapor pressure in operation is at least equal to 150 atm.

2. Description of the Prior Art

In a projector device of the light projection type, there is a demand for illumination of the image uniformly onto a rectangular screen, and furthermore, with sufficient color reproduction. Thus, the light source is a metal halide lamp which is filled with mercury and a metal halide. Furthermore, recently, smaller and smaller metal halide lamps, and more and more often, spot light sources have been produced, and lamps with extremely small distances between the electrodes are used in practice.

Against this background, recently, instead of metal halide lamps, lamps with an extremely high mercury vapor pressure, for example, with a pressure greater than or equal to 200 bar (roughly 197 atm) have been proposed. Here, the increased mercury vapor pressure suppresses broadening of the arc and an extensive increase of the light intensity is desired; this is disclosed in Japanese patent disclosure document HEI 2-148561 (corresponding to U.S. Pat. No. 5,109,181) and Japanese patent disclosure document HEI 6-52830 (corresponding to U.S. Pat. No. 5,497,049).

In a light source device which is used for such a projector device, in conjunction with projection of a clear image, it is considered very disadvantageous that the discharge lamp devitrifies. On the other hand, recently, the DLP (digital light processor) method using MMD (micro mirror device) has been used, by which a liquid crystal cell need no longer be used. This yields smaller and smaller projector devices. This means that, in a discharge lamp for a projector device, there is, on the one hand, a need for high light intensity and high maintenance of illuminance, and on the other hand, a need for a smaller discharge lamp according to the reduction in size of the projector device and for stricter and stricter operating conditions.

The material of the discharge vessel with respect to the UV light transmission property is generally quartz glass. However, there are cases in which a residual stress is produced in the quartz glass during the lamp production steps. This residual stress influences the high light intensity and a high degree of maintenance of the illuminance of the discharge lamp. In conventional lamp production processes, to eliminate or reduce this residual stress, the discharge vessel is subjected to high temperature heat treatment (annealing).

Furthermore, besides eliminating the residual stress in the quartz glass, there is also the technique of controlling the crystal structure in itself. This technique is based on the idea of not removing the residual stress which has formed, but devising a quartz glass in which no stress occurs as a result of its nature. This control of the crystal structure specifically means control of the fictive temperature. It is known that devitrification of the quartz glass can be effectively reduced by using this technique. One such technique is disclosed, for example, in Japanese patent disclosure document HEI 7-215731.

However, from an operating test performed with a discharge lamp based on the technique disclosed in the above described Japanese patent disclosure document HEI 7-215731 used as the light source of a projector device, it was found that, in practice, advantageous operation cannot always be carried out. Specifically, the discharge vessel is devitrified in the course of operation of the discharge lamp, by which the degree of maintenance of the illuminance decreases or by which damage, such as cracks or the like, occur in the discharge vessel. On the experimental level, there are also serious cases in which the discharge vessel is destroyed by these cracks.

SUMMARY OF THE INVENTION

The primary object of the present invention is to devise a super-high pressure mercury lamp for a projector device in which a discharge vessel made of quartz glass is filled with at least 0.15 mg/mm$^3$ of mercury and which has a new arrangement in which both devitrification as well as damage of the discharge vessel can be eliminated.

The object is achieved, in accordance with the invention, in a super-high pressure mercury lamp in which there are a pair of electrodes opposite one another in the quartz glass discharge vessel and in which this discharge vessel is filled with at least 0.15 mg/mm$^3$ of mercury, by the above described quartz glass having a fictive temperature of 11000° C. to 1250° C. and moreover, by the total content of alkali metals being from 0.1 ppm by weight (wt) to 3 ppm by weight (wt) and the aluminum content being from 1 ppm by weight (wt) to 30 ppm by weight (wt).

As a result of careful observation, to achieve the aforementioned object, the inventors noted that, in a super-high pressure mercury lamp for a projector device in which a discharge vessel is filled with an amount of mercury that is greater than or equal to 0.15 mg/mm$^3$ and a halogen gas, neither devitrification nor damage to the discharge vessel can be eliminated solely by controlling the fictive temperature (crystal temperature) of the quartz glass. They have considered the circumstance that the internal lamp pressure (mercury vapor pressure) during operation is extremely high, and have found that to eliminate this defect it is a good idea, in addition to controlling the fictive temperature of the quartz glass, to fix the total content of alkali metals and the content of aluminum which are contained in the quartz glass.

In the above described citation (JP-OS HEI 7-215731) in which the fictive temperature is fixed, there is, in passing, a description of use an excimer lamp and the like for a high pressure mercury lamp. However, the actual description presupposes a low pressure mercury lamp.

Furthermore, the invention relates, not to a general mercury lamp with a mercury vapor pressure during operation of at most 1 atm to 10 atm, but to a lamp filled with at least 0.15 mg/mm$^3$ of mercury in which, during operation, a state with an extremely high pressure of at least 150 atm is produced. This lamp is an extremely small discharge lamp with an inside volume of the discharge vessel (inside volume of the discharge space) of, for example, at most 70 $mm^3$, which has an operating state which is so different that it cannot be compared to a general high pressure mercury lamp.

In the discharge lamp of the above described citation, the fictive temperature is mentioned. However, this presupposes a low pressure mercury lamp. Assuming that an application for a high pressure mercury lamp is mentioned anyhow, this relates to an extremely general high pressure mercury lamp with a pressure of at most roughly 1 atm to 10 atm. The inventors have found that the same effect cannot always be obtained by simple use of the technique described therein for the high pressure mercury lamp according to the invention.

As a result of further detailed consideration, the inventors have also found that alkali metal elements (sodium, potassium and the like) which are found in quartz glass are inserted into the chemical bond of silicon (Si) and oxygen (O), which are components of quartz glass, that these alkali metals are influenced by the mercury and the halogen elements which are present in a large amount within the discharge vessel, and that, in this way, devitrification and damage to the discharge vessel are caused. The inventors have found that the above described adverse affect of the alkali metals can be prevented by mixing aluminum into the quartz glass of which the discharge vessel is formed.

The invention is further described in further detail below with reference to the accompanying the drawings.

BRIEF DESCRIPTION OF THE DRAWINGS

FIG. 2 is a table showing the action of a super-high pressure mercury lamp in accordance with the invention; and FIG. 3 is a table showing the action of comparative super-high pressure mercury lamp examples.

DETAILED DESCRIPTION OF THE INVENTION

Figure 1:
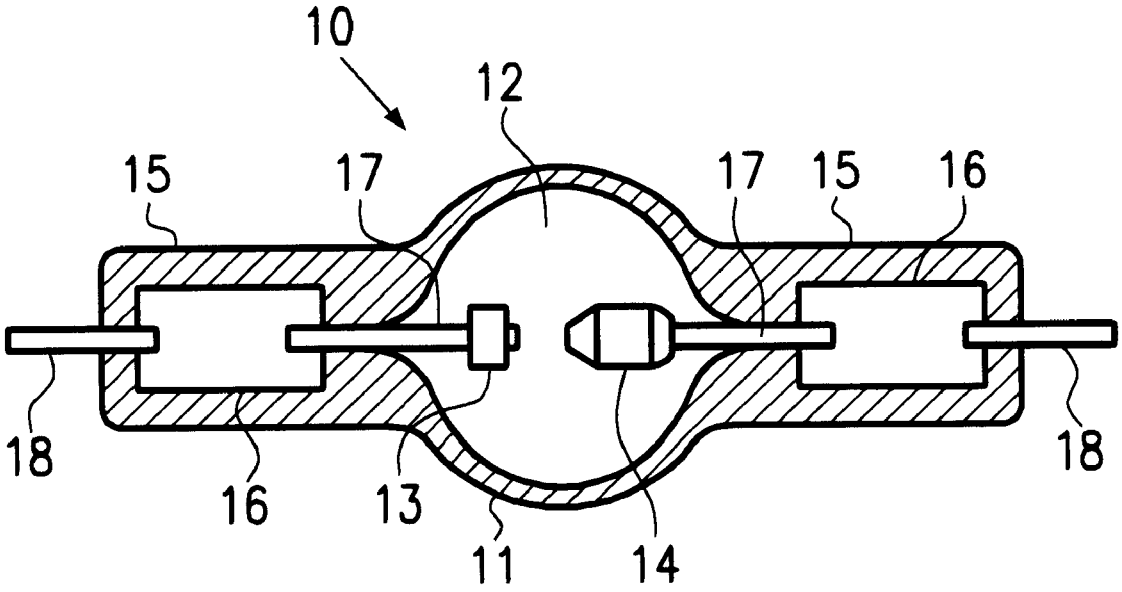
FIG. 1 is a schematic cross-sectional view of the overall arrangement of a super-high pressure mercury lamp in accordance with the invention.

FIG. 1 schematically shows the overall arrangement of a super-high pressure mercury lamp in accordance with the invention (hereinafter also called only a "discharge lamp"). In the figure, a discharge lamp 10 has an essentially spherical discharge space 12 which is formed by a discharge vessel 11 which is made of quartz glass. Within the discharge space 12, a cathode 13 and an anode 14 are disposed opposite one another. Furthermore, hermetically sealed portions 15 are formed such that they extend from opposite ends of the discharge space 12. Within each hermetically sealed portion 15, there is a conductive metal foil 16 which normally is made of molybdenum, for example, hermetically installed by a pinch seal. The base of an upholding part 17 for each electrode, i.e., cathode 13 or anode 14, is located and is welded on one end of the respective conductive metal foil 16 forming an electrical connection between them. On the other end of the respective conductive metal foil 16, an outer lead pin 18, which projects to the outside, is welded on.

The discharge space 12 is filled with mercury, a rare gas and halogen gas. The mercury is used to obtain the required wavelength of visible radiation, for example, to obtain radiant light with a wavelength from 360 nm to 780 $\mu$m, and is added in an amount of greater than or equal to 0.15 $mg/mm^3$. This added amount is different depending on the temperature conditions. For this added amount, however, an extremely high vapor pressure of greater than or equal to 150 atm is achieved during operation. By adding a larger amount of mercury, a discharge lamp with a high mercury vapor pressure of at least 200 to 300 atm can be produced during operation. The higher the mercury vapor pressure becomes, the more readily a light source suitable for a projector device can be implemented. For example, roughly 13 kPa argon gas is added as the rare gas. The rare gas is used to improve the operating starting property.

The halogen is added in the form of a compound of bromine, chlorine, iodine or the like with a metal such as mercury or the like. The amount of halogen added can be chosen from a range of, for example, $10^{-6}$ to $10^{-2}$ micromoles/$mm^3$. The function of the halogen is to prolong the service life using the halogen cycle. In an extremely small discharge lamp with a high internal pressure like the discharge lamp according to the invention, it can be imagined that adding halogen in this way influences the damage phenomenon and devitrification of the discharge vessel described below.

The numerical values of one such discharge lamp are described by way of example below:

The maximum outside diameter of the emission part is 9.5 mm.

The distance between the electrodes is 1.5 mm.

The inside volume of the arc tube is 75 $mm^3$.

The wall load is 1.5 $W/mm^3$.

The nominal voltage is 80 V.

The nominal wattage is 150 W.

This discharge lamp is installed in a device for presentation, such as the above described projector device, an overhead projector or the like, and can offer radiant light with good color reproduction.

The first feature of the super-high pressure mercury lamp according to the invention is that the fictive temperature of the quartz glass comprising the discharge vessel 11 was set in the range from 1000° C. to 1250° C.

Here, the term "fictive temperature" is defined as the scale for showing the quartz glass structure or also the temperature at which the structure is determined. A glass, depending on its heat treatment conditions, has completely different structures. For example, if a glass which is in the state of thermal equilibrium at a high temperature T cools quickly to room temperature, the glass structure solidifies, that state at the temperature T being preserved. This high temperature T in this case is called the "fictive temperature" of the glass. In the case in which the glass which likewise at the high temperature T is in the state of thermal equilibrium is cooled, not quickly, but gradually to a state with a low temperature, the fictive temperature reaches a temperature which is closer to room temperature.

To control the crystal structure of the quartz glass by the fictive temperature, a process is carried out in this way in which thermal equilibrium is obtained and proceeding from this state cooling is performed. As was described above, a fictive temperature which is closer to the temperature in the thermal equilibrium state can be obtained by rapid cooling proceeding from a thermal equilibrium state obtained by high temperature heating.

The conditions for producing quartz glass with a certain fictive temperature are described below:

(1) After heating quartz glass with a fictive temperature of 1400° C. at 1150° C. for 20 minutes, rapid cooling to 900° C. is carried out at a pace of 0.1° C./min. In this way, a quartz glass with a fictive temperature of 1080° C. can be obtained.

(2) After heating quartz glass with a fictive temperature of 1400° C. at 1200° C. for 5 minutes, rapid cooling to 800° C. is carried out at a pace of 15.0° C./min. In this way, a quartz glass with a fictive temperature of 1237° C. can be obtained.

(3) After heating quartz glass with a fictive temperature of 1400° C. at 1050° C. for 120 minutes, rapid cooling to 850° C. is carried out at a pace of 0.5° C./min. In this way, a quartz glass with a fictive temperature of 1192° C. can be obtained.

(4) After heating quartz glass with a fictive temperature of 1400° C. at 1100° C. for 60 minutes, rapid cooling to 800° C. is carried out at a pace of 1.5° C./min. In this way a quartz glass with a fictive temperature of 1180° C. can be obtained.

These are only examples. It is possible to produce quartz glass with different fictive temperatures as a function of various conditions.

One such process for producing the crystal structure of the quartz glass which is fixed by the fictive temperature is generally carried out after the electrodes are sealed in the arc tube and the shape of the discharge lamp has been completed.

As was described above, in a conventional high pressure mercury lamp, high temperature heat treatment (annealing) was carried out as treatment for eliminating stress after the electrodes had been installed and hermetically sealed in the quartz glass tube which is designed to represent the discharge vessel. This treatment eliminates the "stress" which is present in the quartz glass. This treatment is therefore not treatment for controlling the crystal structure of the quartz glass in itself, as is the case in the invention. In high temperature heat treatment as a treatment for eliminating the stress, it is necessary to remain at a high temperature over a long time. To name one example, heat treatment must be continued for at least 10 hours at 1000° C.

This means that control of the crystal structure by the fictive temperature has not only a completely different treatment purpose from the conventionally executed treatment for elimination of stress, but is also advantageous in the sense of simplification and shortening of the length of treatment.

For this reason, there are the process of infrared absorption spectroscopy (FT-IR) as well as Raman spectroscopy as processes for measurement of the fictive temperature of a certain quartz glass. In infrared absorption spectroscopy, the fictive temperature of the glass can be estimated based on the amount of shift of the peak which shows the extent of the Si—O bond of the quartz glass. In Raman spectroscopy, the fictive temperature of the glass can be estimated based on the ratio of the peaks corresponding to the respective ring structure.

Infrared spectroscopy is described specifically and simply. A. Agarwal and others have derived the following formula for computing the fictive temperature:

$$\text{Fictive temperature } (K) = 43809.21/(\text{Peak wave number} - 2228.64) \quad \text{(Formula 1)}$$

That is, the fictive temperature can be determined by inserting into Formula 1 the wave number at which, in the vicinity of 2260 $cm^{-1}$, the transmission factor of the quartz glass to be measured becomes lowest as the peak wave number.

A second feature of the high pressure mercury lamp in accordance with the invention is that the quartz glass of which the discharge vessel 11 is formed has a total content of alkali metals of 0.1 ppm by weight to 3.0 ppm by weight and a total aluminum content of 1.0 ppm by weight to 30 ppm by weight. Here "alkali metals" mean lithium (Li), sodium (Na) and potassium (K). The cumulative content of these elements must be within the above described range. The reason why alkali metals are necessary is to ensure the viscosity of the quartz glass, i.e., that the quartz glass in the high temperature state in the processes of processing into a lamp form and hermetic sealing of the electrode parts requires a glass viscosity of a certain degree.

In the case in which the content of alkali metals is fixed at less than 0.1 ppm by weight, the production costs are much higher since extremely special treatment is necessary for purification. In the case in which the content of alkali metals exceeds 3.0 ppm by weight, devitrification and damage of the discharge vessel are caused because they will conversely be present in the quartz glass in a large amount. The optimum range of the total content of alkali metals is therefore 0.1 ppm by weight to 3.0 ppm by weight.

The reason why aluminum is contained is described below. The alkali metals are, as was described above, necessary for adjusting the viscosity of the quartz glass. However, they move within the glass during lamp operation, break up the Si—O structure of the glass, form impurities, and as a result, cause damage to the discharge lamp and devitrification of the discharge vessel.

Conversely, in the case in which there is aluminum in the glass, the aluminum replaces the Si atoms, forms an area of negative ions, and forces the alkali ions (cations) in the glass into this negative area. The addition of aluminum in a suitable amount therefore leads to a reduction in the mobility of the alkali ions and is designed to capture the motion of the alkali ions in the glass. The content was fixed with respect to the optimum range for performing this function at 1.0 ppm by weight to 30 ppm by weight.

In the case of an aluminum content that is lower than 1.0 ppm by weight, the amount for adequately performing the function of capturing alkali ions is small. In the case of an aluminum content that is greater than 30 ppm by weight, the function of capturing the alkali ions is indeed present, but there is also a function as an impurity; in the case of alkali metals, this causes damage and devitrification of the discharge vessel.

An experiment with respect to the advantage and the action of the super-high pressure mercury lamp is described below. In the high pressure mercury lamp used, the maximum outside diameter of the emission part is 9.4 mm, the distance between the electrodes is 1.3 mm, the inside volume of the arc tube is 75 $mm^3$, the amount of added mercury is 0.25 $mg/mm^3$, the amount of added halogen is $10^{-4}$ $micromoles/mm^3$, the wall load is 1.5 $W/mm^3$, the nominal voltage is 80 V and the nominal wattage is 150 W.

In the experiment, in 50 discharge lamps (for embodiments of the invention, 26 discharge lamps, and for comparison examples which are not encompassed by the invention, 24 discharge lamps) with changed fictive temperatures, alkali concentrations and aluminum concentrations, the damage state and the formation of milky opacification of the discharge vessel were observed for each.

The damage state of the discharge vessel was observed after repeating, ten times, the process of two-minute operation of the discharge lamp and subsequently turning it off for 40 seconds, and the condition at which damage was recognized was recorded. This operating test was carried out for the respective discharge lamp a few dozen times, by which the probability of formation of damage was determined. Here, the term "damage" is defined as a case of the formation of cracks in the discharge lamp and a case of breakage of the discharge lamp. With respect to milky opacification, likewise in the respective discharge vessel, milky-opacified surface of the discharge vessel was observed after 50 hours of operation and moreover the average was recorded in the case in which the respective lamp was operated a few dozen times.

FIG. 2 shows the experimental result in embodiments 1 to 26 of super-high pressure mercury lamps with the above described specification. The alkali concentration shows the total content of lithium, sodium, and potassium, and in the damaged state of the discharge vessel as the condition of an operating test which was carried out a few dozen times, cases were recorded with a degree of damage less than 1% as [o], cases were recorded with a degree of damage from 1% to 5% as [Δ] and, cases were recorded with a degree of damage of at least equal to 5% as [x]. With respect to the devitrified state of the discharge vessel, as the average value in an operating test which was likewise carried out a few dozen times, cases in which in the arc tube portion devitrification of at least 0.5 $cm^2$ occurred were recorded as x, cases in which in the arc tube portion devitrification of 0.1 $cm^2$ to 0.5 $cm^2$ occurred were recorded as [Δ] and cases in which, in the arc tube portion, devitrification of less than to 0.1 $cm^2$ occurred were recorded as [o].

The result in FIG. 2 shows that in the discharge vessel of the discharge lamp neither damage nor devitrification occurred when the fictive temperature is 1050° C. to 1250° C., the alkali concentration is 0.11 ppm by weight to 2.94 ppm by weight, and the aluminum concentration is 2.3 ppm by weight to 29.8 ppm by weight.

With consideration of different measurement errors, from this test, a fictive temperature of 1000° C. to 1250° C., an alkali concentration of 0.1 ppm by weight to 3.0 ppm by weight, and an aluminum concentration of 1.0 ppm by weight to 30 ppm by weight were established as the range in accordance with the present invention.

The experimental result of discharge lamps (comparison lamps 1 to 24) is described below with reference to FIG. 3. In comparison examples 1 to 8, the result of the test is shown which was carried out in discharge lamps, in the case in which the alkali concentration and the aluminum concentration are within the above described range and the fictive temperature is outside the above described range. It is apparent from the test that in comparison example 4, in which the fictive temperature is 1263° C. which is nearest 1250° C., unwanted results have been engendered both with respect to the damage state of the discharge vessel and also the devitrification state of the discharge vessel.

This result shows that exceeding a fictive temperature of 1260° C. (different measurement errors are likewise considered) for a discharge lamp is not desirable even if the alkali concentration and the aluminum concentration are established in an advantageous range.

In comparison examples 9 to 16, the fictive temperature and the aluminum concentration are within the range in accordance with the invention. However, here, the results relate to tests which were carried out with discharge lamps in which the alkali metals are outside of the range as of the present invention. Specifically, a test was carried out with respect to the case in which the content of alkali metals exceeds 3.0 ppm by weight.

The test shows that, in the comparison example 9 in which the alkali metal content is 3.6 ppm by weight which is nearest 3.0 ppm by weight, unwanted results have been engendered both with respect to the damage state of the discharge vessel and also the devitrification state of the discharge vessel.

This result shows that exceeding the content of alkali metals of 3.0 ppm by weight (different measurement errors are likewise considered) for a discharge lamp is not desirable even if the fictive temperature and the aluminum concentration are established in an advantageous range.

In comparison examples 17 to 24, tests were run with respect to the case in which the aluminum content exceeds 30 ppm by weight but the fictive temperature and the alkali concentration are within the range of the present invention.

The tests show that, in the comparison example 19 in which the aluminum content is 32.8 ppm by weight which is nearest 30.0 ppm by weight, unwanted results have been engendered both with respect to the damage state of the discharge vessel and also the devitrification state of the discharge vessel.

This result shows that exceeding the aluminum content of 30.0 ppm by weight (various measurement errors are likewise considered) for a discharge lamp is not desirable even if the fictive temperature and the alkali concentration are established in an advantageous range.

As was described above, the high pressure mercury lamp of the present invention is a small lamp in which the discharge vessel contains at least 0.15 $mg/mm^3$ of mercury and which is used as the light source for a projector device. By establishing the fictive temperature of the quartz glass of which the discharge vessel is formed, the alkali content and the aluminum content in a given range, the disadvantages of damage and milky opacification of the discharge vessel can be advantageously eliminated.

The above described establishment of the fictive temperature, the alkali content and the aluminum content of the quartz glass does mean essentially establishment in the arc tube portion of the discharge lamp. However, for a small discharge lamp with an inside volume of the emission space at most equal to 70 $mm^3$, this establishment can be considered in the entire discharge vessel including the hermetically sealed portions.

According to the invention, the fictive temperature of the quartz glass of which the discharge vessel is formed is established. However, the fictive temperature in the emis sion part and the hermetically sealed portions of the discharge vessel can be changed. The reason for this is that the temperature of the emission part during lamp operation becomes higher than the temperature of the hermetically sealed portions. It is desirable to produce the emission part with a fictive temperature in the ranges from 1050° C. to 1250° C. and preferably 1200° C. to 1250° C.

In a super-high pressure mercury lamp, there are also cases in which no halogen gas is contained, and also cases in which metals besides mercury, rare earth metals and the like are added in addition to mercury.

The super-high pressure mercury lamp in accordance with the present invention is not limited to a lamp which is operated using direct current, but can also be used for a lamp which is operated using alternating current.

Furthermore, the super-high pressure mercury lamp according to the invention can be used for a lamp with an operating position in which the lengthwise axis of the lamp is positioned vertically, horizontally or transversely, or for a lamp with other various operating positions.

The super-high pressure mercury lamp of the invention is installed in a concave reflector. There can be a case in which the concave reflector is provided with a front glass and is hermetically sealed or is essentially hermetically sealed, or an arrangement in which the concave reflector is in an open state without a front glass.

What we claim is:

1. Super-high pressure mercury lamp, comprising:

a discharge vessel made of quartz glass filled with at least 0.15 mg/mm$^3$ of mercury; and a pair of electrodes opposite one another in the discharge vessel the quartz glass of which the discharge vessel is made has a fictive temperature of 1000° C. to 1250° C. and a total content of alkali metals of 0.1 ppm by weight to 3 ppm by weight and an aluminum content of 1 ppm by weight to 30 ppm by weight.

2. Super-high pressure mercury lamp as claimed in claim 1, wherein the quartz glass of which the discharge vessel is made has a fictive temperature of 1050° C. to 1250° C.

3. Super-high pressure mercury lamp as claimed in claim 1, wherein the quartz glass of which the discharge vessel is made has a fictive temperature of 1200° C. to 1250° C.

4. Super-high pressure mercury lamp as claimed in claim 1, wherein the mercury is added in an amount to achieve a vapor pressure of greater than or equal to 150 atm during operation.

5. Super-high pressure mercury lamp as claimed in claim 1, wherein the mercury is added in an amount to achieve a vapor pressure of from 200 to 300 atm during operation.

6. Super-high pressure mercury lamp as claimed in claim 1, wherein halogen is added in an amount of $10^{-6}$ to $10^{-2}$ micromoles/mm$^3$ of discharge space.

* * * * *